United States Patent [19]

Depuy et al.

[11] Patent Number: 4,977,939

[45] Date of Patent: Dec. 18, 1990

[54] KNIFE ASSEMBLY FOR CHIPPER

[75] Inventors: Garth D. Depuy, Carthage; Eugene A. Farrell, Fisher Landing, both of N.Y.

[73] Assignee: Carthage Machine Company, Carthage, N.Y.

[21] Appl. No.: 519,945

[22] Filed: May 7, 1990

[51] Int. Cl.[5] ..... B27C 7/10; B02C 18/18

[52] U.S. Cl. ..... 144/176; 144/241; 241/92; 241/298

[58] Field of Search ..... 144/162 R, 176, 218, 144/241, 230; 241/92, 292, 292.1, 298; 407/45, 95, 96

[56] References Cited

U.S. PATENT DOCUMENTS

| | | | |
|---|---|---|---|
| 3,542,302 | 11/1970 | Salzmann, Jr. | 144/176 |
| 4,298,044 | 11/1981 | Hansel et al. | 144/176 |
| 4,346,744 | 8/1982 | Beer et al. | 144/176 |
| 4,503,893 | 3/1985 | De Mopoulos | 241/92 |
| 4,694,995 | 9/1987 | Holmberg et al. | 241/92 |
| 4,784,337 | 11/1988 | Nettles et al. | 144/176 |
| 4,887,772 | 12/1989 | Robinson et al. | 144/176 |

*Primary Examiner*—W. Donald Bray
*Attorney, Agent, or Firm*—Wall and Roehrig

[57] ABSTRACT

A chipper knife blade assembly for a rotary disk chipper has first and second flat knife blades of substantially identical construction, with one of the blades serving as a chipper blade and the other serving as a counterknife supporting the chipper blade. The counterknife is seated on a sloping support surface in a recess in the disk and has its proximal edge reposed against a support or a thrust bar. A bolt-down clamping member has a shouldered surface with a flat portion clamped down against a top surface of the chipper knife blade, and with a shoulder supporting the proximal edge of the chipper blade. In a preferred embodiment, the chipper blade projects about one-half inch to three-quarters inch beyond the cutting edge of the counterknife blade. With this arrangement, a warn cutting blade can serve a second useful life as a counterknife, absorbing the wear that results from the chips moving at high speed into the chip slot.

4 Claims, 1 Drawing Sheet

KNIFE ASSEMBLY FOR CHIPPER

Background of the Invention

The present invention relates to disk-type chippers, and in particular to an improved knife assembly employing a knife blade as a counter knife.

Chippers of this general type are well known, and one example is described in U.S. Pat. No. 4,784,337 to Nettles et al. The chipper there described is of the well-known Carthage-Norman design in which a vertical disk rotates upon a horizontal drive shaft. The disk is covered by a housing with a removable head, and a spout or feeder that projects from the housing receives and guides logs into the disk. The logs are fed, generally end-on, to a series of radially disposed knives carried on the disk. The knives are clamped in place at cutting stations around the disk, and chip slots or passages through the disk are situated adjacent the cutting knives at the cutting stations. The wood chips cut from the logs move through the chip slots and are ejected from the machine via a casing discharge area. The spout or feeder has a stationary bedknife that cooperates with the rotary knives so that the logs are cut into uniform chips suitable to be supplied, e.g., to a digester of a wood pulping process.

The blades of the knife assemblies are the parts of the chipper most subject to wear. Ideally, the blades should be easy to replace and to adjust accurately. When the blades need a new edge, material is ground off the blades by resharpening them. Also, adjustment is required when there is a need to change chip size. Consequently, the blades should be adjustable and firmly supported in the appropriate positions.

In a disposable knife system, the conventional resharpenable chipper knife is replace with an adaptor or cassette and knife assembly. The knife assembly can be comprised of a two-piece knife blade, a cassette, and a top hold-down plate. One such device is disclosed in U.S. Pat. No. 4,784,337. In this system a reversible, double-edge knife blade fits an elongated cassette that has a blade-receiving recess formed on it. The knife blade has a cutout on its underside which fits a rib or key on the cassette. The knife blade is held in place by fasteners, a retaining bar, or the like, that covers one edge, so that the other edge of the knife blade is accurately positioned at the entrance to a chip slot. Adjustment of blade position is effected by forming babbitt pads at the back or proximal surface of the cassette.

The cutouts at the underside of the blades can have a weakening effect, unnecessarily leading to fracturing of the blades during a chipping operation. However, with the system of the above-mentioned patent, it is not possible to employ a keyless, flat blade.

The smaller, double-edge blades now available require a unique profile which is critical to their clampability; this profile can be a key, groove, waist, etc. This structure can also create a weak point that may fracture in service.

In chippers that employ a single-edge, resharpenable blade, it is the practice to mount a wear plate or counter knife beneath the cutting knife and adjacent its cutting edge. The counter knife serves the dual purposes of backing the cutting knife and absorbing abrasion from the wood that passes through the chip slot. This type of blade and counterknife arrangement is shown, e.g., in U.S. Pat. No. 4,298,044 to Hansel et al. and in U.S. Pat. No. 3,144,995 to Fontaine. The position and amount of projection for both the cutting blade and the counterknife can be adjusted by babbitting. Previous systems have employed special parts as the counterknife, which means that an additional stock of counterknives must be kept on hand, as well as a stock of cutting knives. It is also the case for previous chippers that when a blade became too worn for resharpening, it had to be discarded or salvaged for its metal value, but could no longer be employed in the machine.

Objects and Summary of the Invention

Accordingly, it is an object of this invention to provide a simple yet effective chipper cutting blade and counterknife assembly for chippers, and which avoids the drawbacks of the prior art.

It is another object of this invention to provide a chipper blade assembly in which a worn blade can be employed as the counterknife.

It is a further object of this invention to provide a chipper knife blade assembly which achieves a high chip quality with a minimum amount of parts.

It is a still further object of this invention to provide a chipper with a minimum of steps and openings in the disk surface.

It is a yet further object of this invention to provide a chipper with the advantageous features of ease of adjustment for chip size, ease of knife changes, and ease of manufacture.

According to an aspect of this invention, the chipper knife blade assembly has at least first and second flat knife blades each with a flat base surface, a flat top surface, a tapered side that slopes downward from the top surface to the base to define a cutting edge, and a back or distal surface away from the cutting edge. The second blade is situated behind the first knife and serves as a counterknife, with the base surface of the counterknife or second blade supporting the base surface of the first or chipping blade. Aside from the fact that the first blade must have a keen cutting edge and the second blade does not need a sharp edge, the first and second blades can be of substantially identical construction. Indeed, it is desire that a worn chipper blade can serve a second life as a counterknife, which reduces the variety of replacement parts that must be kept in inventory. Also with this system relatively inexpensive planer blades can be paired and used as chipper blades.

These blades are supported in a recess in the disk adjacent an entry throat to the chip slot and are clamped down by a blade holder clamp. The blade holder clamp has a shoulder that engages the back surface of the first or chipping blade to maintain the first blade cutting edge projecting a short distance, i.e. one-half inch to three-quarters inch, beyond the corresponding edge of the second blade or counterknife.

With this arrangement, a hard surface on the disposable second blade absorbs the greatest portion of wear and abrasion from the wood chips entering the chip slot. This reduces the maintenance required for the machine.

The above and other objects, features, and advantages of this invention will be appreciated from a consideration of the ensuring detailed description of a preferred embodiment, which should be read in connection with the accompanying Drawing.

Detailed Description of a Preferred Embodiment

Figure 2:
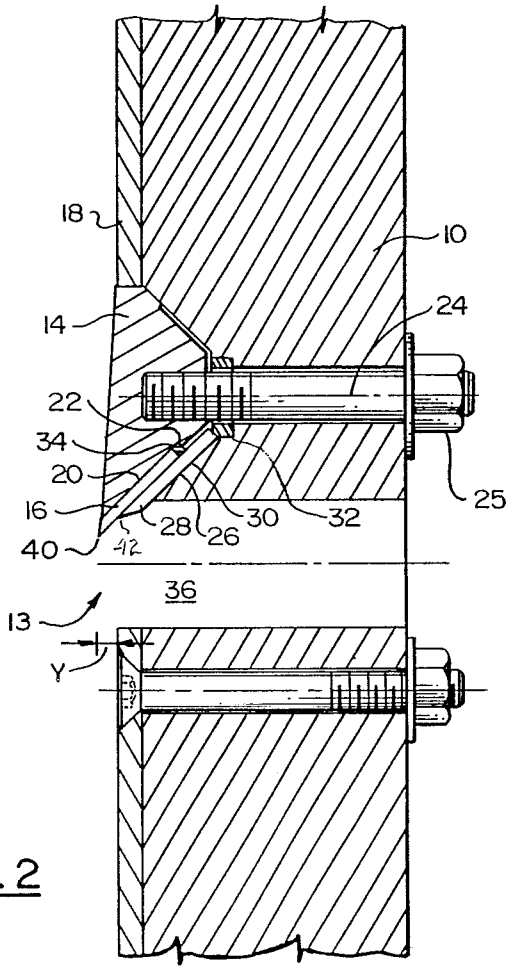
FIG. 2 is a sectional view of a portion of a chipper disk, showing a knife assembly according to one embodiment of this invention installed adjacent a chip slot therein.
Figure 1:
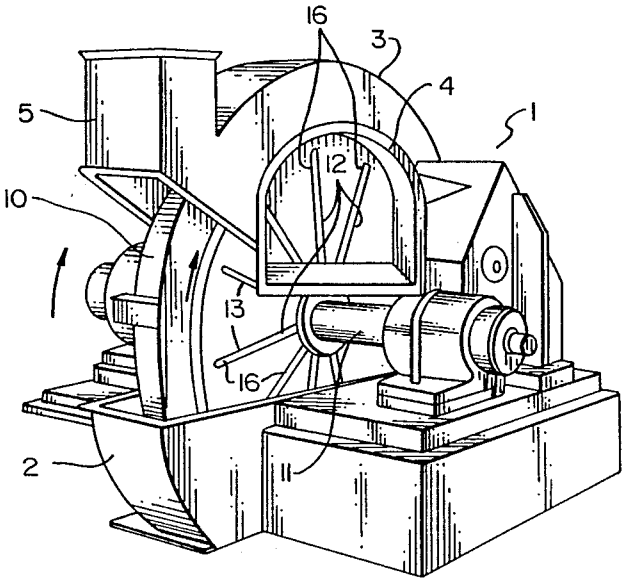
FIG. 1 is a perspective view of a chipper which employs knife assemblies according to an embodiment of this invention.

Referring to FIGS. 1 and 2 of the drawing a large, vertical-disk type log chipper 1 can be of the well-known Carthage-Norman design, as described, e.g., in U.S. Pat. No. 4,784,337. The chipper 1 has a lower enclosure 2 and a hood 3 which contains a spout or log chute 4 as well as an exhaust chute 5. A portion of the enclosure has been removed, to make visible a portion of the large rotary disk 10 of the machine. The disk 10 is motor driven with an axle 11 disposed below the spout 4. Distributed around the disk 10 are between three and fifteen more-or-less radially extending chip slots 12 that pass through the disk 10. Each chip slot defines a cutting station 13. The disk 10 rotates in the direction shown by an arrow.

As shown in FIG. 2, at each cutting station 13 there is a knife holder clamp 14 secured to a vertical front face of the disk 10. A single-edge chipper knife 16 is mounted at an angle of about 30 to 45 degrees adjacent to the associated chip slot 12. A hardened wear plate 18 covers the remainder of the front surface of the disk 10.

The clamp 14 has a sloping upper clamping surface 20 which contacts an upper surface of the knife blade 16. A shoulder 22 on this surface 20 projects outward to support the back or proximal surface of the blade 16. A threaded stud 24 holds the clamp 14 down against the disk, and is secured, e.g., by a hex nut 25. A recess 26 is provided in the disk 10 to receive and support a counterknife 28, which here is a blade substantially identical to the blade 16. Both of the blades 16 and 28 have a base surface of a predetermined breadth, a top surface opposite the base surface, and which defines a blade thickness, and a front tapered surface which slopes to the base surface to define a cutting edge. Both of the blades 16 and 28 have a flat back surface on the side opposite the cutting edge.

The recess 26 has a sloping support surface 30 on which the top surface of the counterknife blade 28 is supported. A thrust bar 32 is situated at or just beyond the proximal end of this flat sloping surface 30. The thrust bar 32 has a support surface against which the back or proximal surface of the second blade 28 is supported. The shoulder 22 of the blade holder clamp 14 is spaced about one half inch from the support surface of the thrust bar 32, i.e. in the breadth directions of the blades 16 and 28. The blades 16 and 28 have approximately the same thickness of about 5/32 inch and each has a breadth of approximately two inches. A babbitt spacer or shim 34 can be disposed between the shoulder 22 and the back surface of the blade 16 to adjust the amount of projection of the front cutting edge 40 of the blade 16 into the throat 36 in the chip slot 12. The babbitt shim 34 can be formed at a desired thickness so that the edge 40 of the blade 16 projects beyond the corresponding edge 42 of the blade 28 a distance of between $\frac{1}{2}$ inch and $\frac{3}{4}$ inch. This also permits the axial projection of the blade 16 to be accurately controlled so that the dimension Y, which is the axial projection of the blade 16 above the leading edge of the wear plate 18, can be selected within a range of about 0.30 inch to about 0.65 inch, to produce chips of desired sizes of about $\frac{1}{2}$ inch to about 1 inch.

As mentioned previously, the blades 16 and 28 can be relatively inexpensive planer blades. Because they back each other up, the two planer blades together are sufficiently robust for chipping.

For babbitting purposes, apertures can be formed along the proximal edge of each of the blades 16 and 28, so that babbitt shims can be formed on the blades. By "babbitt" is meant not only the traditional alloys of copper, zinc, and antimony, but also other shim materials that may be suitable for that purpose.

While this invention has been described in detail with reference to a single preferred embodiment, it should be understood that the invention is not limited to that precise embodiment, rather many modifications and variations would present themselves to those with skill in the art without departing from the scope and spirit of this invention, as defined in the appended claims.

What is claimed is:

1. A chipper knife assembly for a chipper device of the type having a plurality of such knife assemblies readily disposed on a front face of said rotary disk, each blade assembly being disposed adjacent to a chip slot that passes axially through the disk; each said knife assembly comprising a first elongated flat knife blade having a base surface of a predetermined breadth, a top surface spaced a predetermined distance from said base surface to define a thickness of the knife blade, a tapered side that slopes from said top surface to the base surface to define a cutting edge of the blade, and a back surface away from said cutting edge; a second knife blade serving as a counterknife and having a flat base surface of substantially the same predetermined breadth, an opposite surface spaced substantially the same predetermined distance from the associated base surface to define substantially the same thickness for said second knife blade, a tapered side that slopes from the opposite surface to said base surface, and a back surface opposite said tapered surface, said second knife blade being disposed in a recess in said disk with said opposite surface thereof facing said disk; and a blade holder clamp for clamping the first blade against said second blade in the recess in said disk, said clamp having a shoulder for engaging the back surface of said first knife blade to maintain the first blade with its cutting edge projecting out at least a predetermined amount beyond the cutting edge of said second knife blade.

2. A chipper knife assembly according to claim 1 wherein said recess of said disk for the second blade has a flat sloping surface on which the second blade reposes, and further comprises a thrust bar situated at a proximal end of said flat sloping surface and having a support surface against which the back side of the second blade is supported.

3. A chipper knife assembly according to claim 1 wherein for each of said blades the predetermined breadth is substantially two inches and said first knife cutting edge projects from about one-half inch to about three quarters inch beyond the cutting edge of the second blade.

4. A chipper knife assembly according to claim 2 wherein the shoulder on the blade holding clamp is spaced about one half inch from the support surface of the thrust bar, in the breadth direction of said blades.

* * * * *